United States Patent [19]

Harken

[11] 4,074,892

[45] Feb. 21, 1978

[54] PLURAL BEARING AND SHEAVE ASSEMBLY

[75] Inventor: Peter O. Harken, Pewaukee, Wis.

[73] Assignee: Vanguard, Inc., Pewaukee, Wis.

[21] Appl. No.: 724,327

[22] Filed: Sept. 20, 1976

[51] Int. Cl.[2] ..... B66D 3/04

[52] U.S. Cl. ..... 254/188; 114/109; 308/18; 308/189 R

[58] Field of Search ..... 308/18, 163, 189 R, 308/207 R, 190, 172, 37, 3 R; 254/192, 188, 195, 196, 197, 139.1, 161, 162, 163, 164, 186 R, 186 HC, 189; 74/230.01; 114/204, 205, 109

[56] References Cited

U.S. PATENT DOCUMENTS

| | | | |
|---|---|---|---|
| 525,560 | 9/1894 | Marshall | 254/161 |
| 811,254 | 1/1906 | Smith | 254/161 X |
| 2,260,345 | 10/1941 | Smith et al. | 254/192 |
| 3,125,126 | 3/1964 | Engels | 308/18 X |
| 3,528,645 | 9/1970 | Harken | 254/195 X |

*Primary Examiner*—Trygve M. Blix
*Assistant Examiner*—Douglas C. Butler
*Attorney, Agent, or Firm*—Gary, Juettner & Pyle

[57] ABSTRACT

A plurality of adjacent sheaves are disposed around a common shaft. Each sheave carries a plurality of ball bearings engaged between an inner race of the sheave and the shaft. The ball bearings in one sheave are exposed on one side and bear against an adjacent sheave around the shaft such that friction between a sheave and the shaft and between adjacent sheaves is minimized.

10 Claims, 5 Drawing Figures

PLURAL BEARING AND SHEAVE ASSEMBLY

BACKGROUND OF THE INVENTION

The mounting of a plurality of separate rotating members on a common shaft is very well known and has a number of diverse applications. In a typical application, each rotating member will carry its own separate bearing system, in order to be independently rotatable. A common problem in all of such arrangements is the possible friction between adjacent members, particularly when rotated at different speeds. Such problem is not solved by the use of spacers between adjacent members or stops or shoulders on the shaft, due to the friction between the member and its spacer, stop or shoulder. Friction between adjacent rotatable members is especially problematic in arrangements wherein the rotatable members are slidably mounted on the shaft, such that the members become loaded against each other.

In my U.S. Pat. No. 3,528,645, there is described a bearing or pulley block utilizing ball bearings on both sides of the sheave. The balls provide bearing support not only for the sheave, but also bear against the side plates of the block, thereby greatly reducing friction and binding.

SUMMARY OF THE INVENTION

In the present invention, the advantages of ball bearing races are applied to a plurality of rotatable members that are slidably mounted upon a common shaft. Each member, such as an annular sheave, has an annular surface defining an outer race and a web extending radially inward from one side of the race but spaced from the shaft. The side of the sheave opposite the web is open. A plurality of ball bearings are provided between the outer race and the shaft, with the balls also bearing against the web. A plurality of such sheaves are arranged side by side on the shaft, whereby the balls of one sheave also bear against the web of an adjacent sheave, thereby greatly minimizing friction between adjacent sheaves. The web may comprise an annular projection or rim bearing against the adjacent set of bearings.

THE DRAWINGS

DESCRIPTION OF THE PREFERRED EMBODIMENTS

Figure 1:
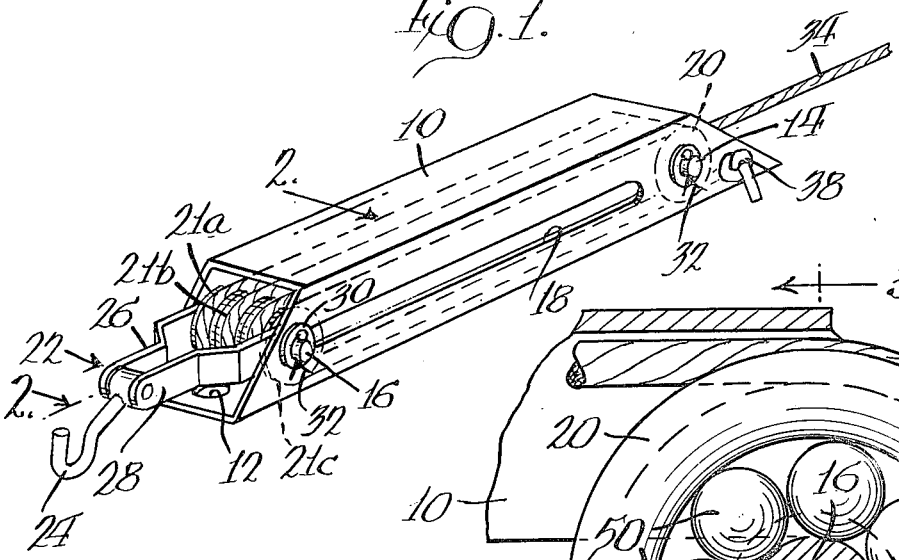
FIG. 1 is a perspective view of a multiple purchase unit incorporating features of the present invention.
Figure 2:
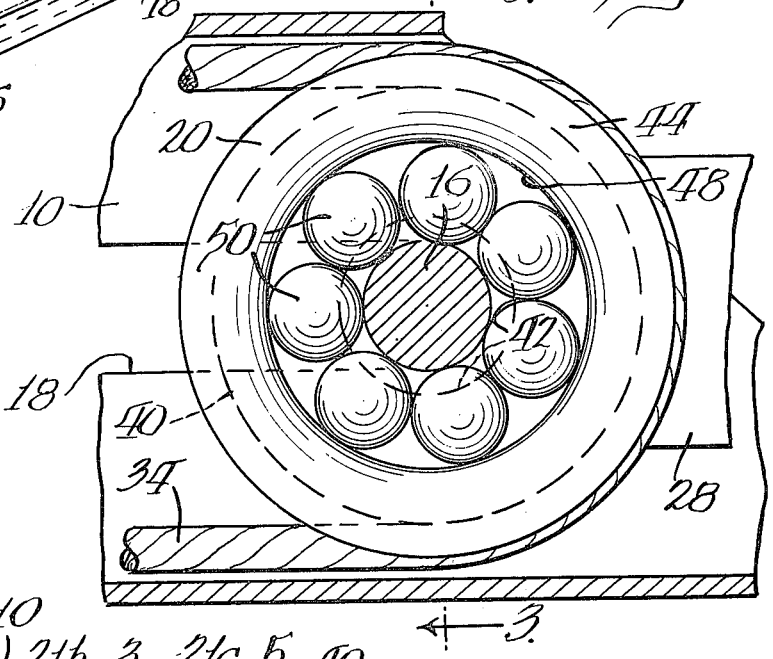
FIG. 2 is a sectional view taken along line 2—2 of FIG. 1.

The bearing system of the present invention will be particularly described in connection with a compact multiple purchase arrangement, an example of which is a unit used on sailboats to obtain high purchase along a limited distance with a minimal amount of effort. As shown in FIG. 1, the unit includes an elongated tube or rectangular housing 10 having open ends. The housing

10 may include holes 12 on one of the walls, especially the bottom wall, to enable securement with bolts, screws or the like to another stationary object.

A pair of parallel shafts 14 and 16 are mounted transversely in the housing. One of the shafts 14 is mounted in a pair of aligned openings near one end of the housing. The other shaft 16 is slidably mounted in a pair of aligned elongated slots 18 that extend along a substantial length of the side walls of the housing. The shaft 16 is therefore movable or slidable in the slots 18 toward and away from the relatively fixed shaft 14 in the housing 10. The sliding shaft 16 is mounted so as to remain substantially parallel to the shaft 14.

A plurality of rotating members or sheaves 20 and 21 are rotatably mounted about each of the respective shafts 14 and 16. In the embodiment shown, the shaft 14 carries three sheaves 20, and the shaft 16 also carries three sheaves 21, designated as 21*a*, 21*b*, and 21*c*, the respective sheaves of each group rotating substantially in parallel and in respective longitudinal alignment. It will be understood that the present invention is applicable to one or more sheaves mounted on a given shaft.

A bifurcated bracket 22 is connected to the movable shaft 16, and a hook 24 or other connection means is provided on the free end of the bracket and constitutes the working end of the unit. The respective legs 26 and 28 of the bracket are engaged around the shaft 16 outside of the sheaves 21 between the outermost sheaves and the inner side walls of the housing, so as not to interfere with the coaction between adjacent sheaves. A washer 30 is provided on each end of the shaft 16 bearing against the respective outer side wall surfaces around the slot 18, which prevents the shaft 16 from becoming misaligned in the slots 18 and with the fixed shaft 14. Cotter pins 32 or other retaining means are provided at the ends of the shafts 14 and 16 to retain the shafts in axial position.

Figure 3:
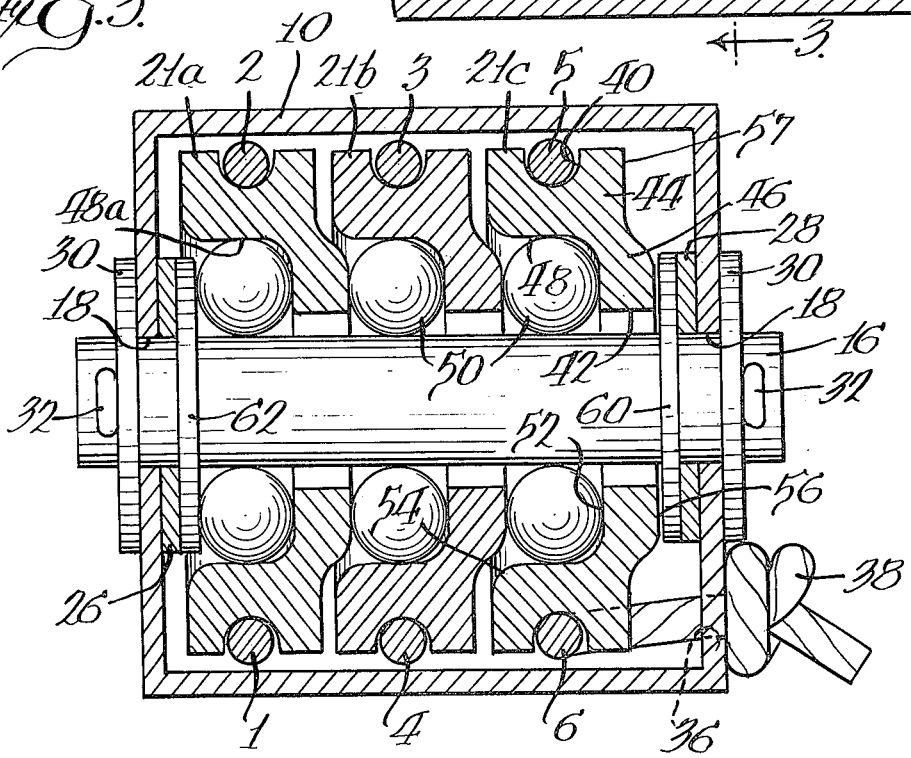
FIG. 3 is a sectional view taken along line 3—3 of FIG. 2.

A flexible line 34 is wrapped back and forth between successive sheaves as shown in FIGS. 1 and 3. The free end of the line enters at the bottom of the enclosure through a pair of the outermost sheaves, which is illustrated as position 1 in FIG. 3. The line is then wrapped around and between respective sheaves 20 and 21 in a zigzag fashion as indicated in the successive positions 2, 3, 4, 5 and 6 on the sheaves 21 in FIG. 3. The free end of the line is then secured to the housing, such as by passing the end through an opening 36 in the bottom wall housing 10 and securing the same by a knot 38.

The sheaves 20 and 21 are substantially identical, and only the construction of the sheaves 21 will be described for the sake of brevity. Each sheave is disc-shaped in form and may be constructed of polymeric, metallic, or other material. The sheave has a circumferential groove 40 to receive and carry the flexible line 34 therein, which line may be composed of wire, yarn, or the like. The sheave also includes a central axis opening 42 that is larger in diameter than the diameter of the shaft 16. The sheave itself is substantially Y-shaped and comprises an annular portion 44 spaced from the shaft and a disc-shaped wall or web 46 extending radially inwardly from one side of the annular portion and spaced from said shaft.

The axially inwardly facing surface of the annular portion 44 of the sheave defines an outer annular race 48, and the cylindrical surface of shaft 16 defines the inner race. Mounted between the inner race and the outer race 48 are a plurality of ball bearings 50 arranged in a substantially loosely fitting circular relationship, whereby adjacent balls in a given race may slidably or rotatably contact one another. One side of the web 46 defines a side race 52 for contact by the balls 50. The balls therefore tangentially contact the outer race 48, the inner race defined by shaft 16 and a side race 52 defined by the web 46, said balls being otherwise preferably spaced from adjacent surfaces of the sheave, particularly at the juncture between the annular portion 44 and the web 46.

It may be seen in FIG. 3 that the side of the sheave 20 or 21 opposite the web 46 is devoid of a web and is therefore open, exposing one side of the balls 50. In fact, the surface adjacent the open side of the sheave is preferably curved outward, as indicated at 54, to afford maximum side exposure of the balls.

In the preferred embodiment, the sheave 20 or 21 is shaped such that the circle defined by the bottom of the line receiving annular groove 40 is coplanar with the circle defined by the centers of gravity of the balls 50, whereby the radial inward load exerted by the line 34 on the sheave is borne directly and uniformly by the balls, as shown in FIG. 3. Also as shown, the edges of the balls facing the open side of the sheave are preferably spaced inwardly from the side surface thereof, whereby the balls are somewhat recessed in the annular L-shaped groove defined by the surfaces 48 and 52.

In addition, the web 46 preferably comprises an annular flat external projection 56 near the axial inner periphery thereof, said projection being spaced axially or laterally away from the annular portion 44 beyond the corresponding side 57 thereof. The projection 56 is sized and otherwise adapted to extend into the L-shaped recess defined by the surfaces 48 and 52 so as to contact the balls 50 of an adjacent sheave, while otherwise being spaced from the adjacent sheave and the shaft 16. For example, the projection from the sheave adjacent the open side of the sheave 44, 46 bears against the balls 50 of the latter, thus forming a second side race for said balls and thus confining the balls in the open groove of the sheave. At the same time, the combination of the adjacent surface and the balls also serves to minimize friction between adjacent sheaves.

It may be seen that an indefinite number of sheaves may be rotatably mounted on a common shaft while providing ball bearing contact between adjacent sheaves. Thus, the benefit of ball bearings is not only provided between individual sheaves and the shaft but also between adjacent sheaves, thus greatly minimizing friction in the system, particularly in applications in which adjacent sheaves rotate at different speeds and otherwise would tend to exert friction and bind on each other.

The arrangement shown in FIG. 1 illustrates an example of a multiple purchase system in which adjacent sheaves rotate at different speeds. When the free end of line 34 is pulled, the shaft 16 moves toward the shaft 14 against the load on connector 24. In so doing, the sheave 21*a* rotates at a faster rate than sheave 21*b*, which in turn rotates faster than the sheave 21*c*, with corresponding sheaves 20 rotating at corresponding differential rates.

An important feature of the present invention is the assembly of the sheaves 20, 21 and the balls 50 onto the shaft 16. A washer 60 may be first placed on the shaft 16 to serve as a bearing surface for the web 46 of the sheave. The shaft 16 is then held in a vertical position, the first sheave 21*c* is threaded onto the sheave, and a sufficient number of balls 50 are added to fill the recess between the surfaces 48 and 52 and the shaft. This process is continued by threading the second sheave 12*b* onto the shaft, adding balls, and so on. Preferably, a washer 62 is placed onto the exposed balls in the final sheave 21*a* so as to bear between the housing and the balls, such washer having a diameter less than the diameter of the outer race 48*a* of the sheave 21*a*. The assembly is constructed such that the sheaves 21*a*, 21*b* and 21*c* are retained in position by the use of fixed bearing surfaces at both ends of the assembly.

Furthermore, it may be seen that the web 46 of the sheave 21*c* that receives the least degree of rotation relative to other sheaves is allowed to bear directly against the washer 60, since friction from this sheave is less than the friction from the other sheaves. The outside sheave 21*a* carrying the first wrap of the line has the exposed balls thereof in contact with the washer 62, thus minimizing friction on the side of the sheave.

Figure 4:
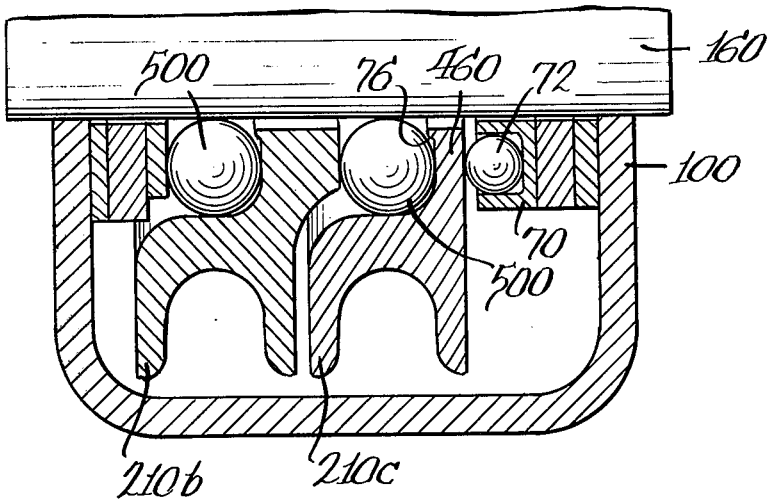
FIG. 4 is a fragmentary vertical sectional view of another embodiment of a plural bearing and sheave assembly of the present invention.

A modification of the arrangement shown in FIG. 3 is illustrated in FIG. 4. Sheaves 210*b* and 210*c* are arranged on a common shaft 160 with balls 500 as hereinbefore described. In order to further reduce friction on the external side of the web 460, an annular U-shaped bearing race 70 open at the inboard side may be disposed on the shaft adjacent the side wall of the housing 100. A plurality of balls 72, usually of a smaller diameter than the balls 500, are provided in the race 70 such that the balls face sideways and contact the web 460 in a tangential fashion, with said web being spaced from adjacent surfaces of the race 70. In this manner, both sides of each of the webs of the sheaves enjoy bearing contact with the ball bearings. It may also be seen that due to the arrangement shown, the web 460 of sheave 210*c* does not require an annular projection for contact with the balls 72.

An additional feature shown in FIG. 4 is a small ledge or circular rib 76 formed on the side of the web at the axially innermost edge thereof. The rib 76 faces the open ball race of the sheave. This feature allows the balls 500 to be assembled into the race of the sheave prior to threading the sheave onto the shaft 160 and prevents the balls from falling out of the race prior to assembly.

Figure 5:
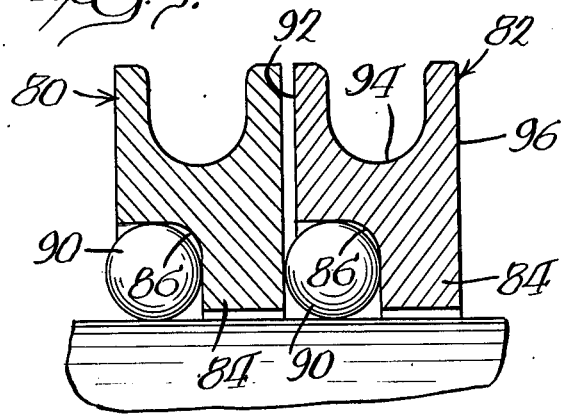
FIG. 5 is a fragmentary vertical sectional view of a further embodiment of a plural bearing and sheave assembly of the present invention.

A further embodiment of the invention is shown in FIG. 5, in which a pair of adjacent sheaves 80 and 82 are shown for the purpose of illustration. The sheaves 80 and 82 are generally similar in design to those previously described with the exceptions hereinafter noted. The webs 84 of the sheaves do not have an annular projection extending into the open side of the race 86 of the adjacent sheave; rather, the other surface of the web 84 is flush with the side of the sheave. The race 86, however, is sized such that the balls 90 project slightly outward from the other side 92 of the sheave, thus allowing bearing contact with the web of the adjacent sheave. In this embodiment, it will be noted that the circle defined by the center of gravity of a set of balls is offset to one side from the circle defined by the bottom of the sheave groove 94.

I claim:

1. A plural rotating assembly comprising shaft means, a plurality of rotatable members around said shaft means and being spaced therefrom, ball bearing means associated with each of said rotatable members and providing bearing support between respective rotatable members and said shaft means, said ball bearing means of a first rotatable member being exposed at one side of said member, an adjacent rotatable member at said one side having a surface in bearing contact with the ball bearing means of said first member with said first and adjacent members being otherwise spaced from each other.

2. The assembly of claim 1 wherein at least said adjacent rotatable member comprises an annular body having on said one side a web extending radially inwardly toward said shaft means but spaced therefrom, said web defining said surface in bearing contact with the ball bearing means of said first member.

3. The assembly of claim 2 wherein said web has an annular projection extending therefrom into bearing contact with the ball bearing means of said first member.

4. The assembly of claim 2 wherein said annular body, the web thereon, and said shaft means define retaining means for said ball bearing means, said ball bearing means being exposed and extending beyond the side of the member opposite said web.

5. The assembly of claim 2 wherein said web has a lateral projection at the end thereof extending toward the said one side of said member for retaining said ball bearing means in said member during assembly.

6. The assembly of claim 1 wherein at least one of said rotatable members comprises a sheave having a circular line carrying groove therein.

7. The assembly of claim 1 wherein said ball bearing means comprises a plurality of balls arranged in a circular pattern and bearing between said rotatable members and said shaft means.

8. The assembly of claim 1 further comprising retainer means on said shaft on both sides of said plurality of rotatable members for retaining said rotatable members in a bearing relationship.

9. A plural rotating assembly comprising an elongated housing, a fixed first shaft near one end of the housing, a first plurality of sheaves rotatably mounted on said first shaft, a pair of opposite aligned slots near the other end of said housing, a second shaft slidably mounted in said slots in substantially parallel relationship with said first shaft, a flexible line wrapped around opposite successive sheaves and having one end secured to said housing, and ball bearing means for rotatably supporting said sheaves on said shafts, said ball bearing means bearing between adjacent sheaves and said shaft with said sheaves otherwise being spaced from each other and said shaft.

10. A method for assembling a plurality of ball bearing supported rotatable members on a shaft comprising the steps of first providing a plurality of rotatable members having an annular body and an axially inwardly projecting circular web on one side thereof defining an open recess with said body, and; second, irrespective of order, placing a set of balls in said open recess and threading said rotatable member on said shaft, and third, threading an additional rotatable member onto said shaft in accordance with said second step with the web of said second member facing the set of balls of said first member.

* * * * *